US011306483B2

(12) United States Patent
Santa Claus

(10) Patent No.: US 11,306,483 B2
(45) Date of Patent: Apr. 19, 2022

(54) SUNSHADE AND A METHOD OF CONSTRUCTING A SUNSHADE

(71) Applicant: O Santa Claus, Killara (AU)

(72) Inventor: O Santa Claus, Killara (AU)

( * ) Notice: Subject to any disclaimer, the term of this patent is extended or adjusted under 35 U.S.C. 154(b) by 66 days.

(21) Appl. No.: 17/284,183

(22) PCT Filed: Oct. 10, 2018

(86) PCT No.: PCT/AU2018/051092
§ 371 (c)(1),
(2) Date: Apr. 9, 2021

(87) PCT Pub. No.: WO2019/071305
PCT Pub. Date: Apr. 18, 2019

(65) Prior Publication Data

US 2021/0340771 A1 Nov. 4, 2021

(30) Foreign Application Priority Data

Oct. 11, 2017 (AU) ..... 2017904101

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04F 10/08; E06B 9/26
See application file for complete search history.

(56) References Cited

U.S. PATENT DOCUMENTS 4,486,073 A * 12/1984 Boyd ..... E06B 9/386 160/166.1
4,509,825 A * 4/1985 Otto ..... F21S 11/00 160/236

(Continued)

FOREIGN PATENT DOCUMENTS

AU 600371 B2 8/1990
AU 642550 B2 10/1993

(Continued)

OTHER PUBLICATIONS

International Search Report issued in PCT/AU2018/051092 dated Jan. 10, 2019, pp. 1-3.

(Continued)

*Primary Examiner* — Beth A Stephan
(74) *Attorney, Agent, or Firm* — The Belles Group, P.C.

(57) ABSTRACT

The present invention relates to sunshades and methods of constructing sunshades, particularly, sunshade canopies installed at a fixed location in the temperate zones.

In a first aspect of the invention, a sunshade element is configured such that the sunshade element is viewed from a reference shade point as a thin profile between adjacent apertures over predetermined days in winter, thereby maximising the admission of sunshine to the shade area; and configured such that the sunshade element presents the maximum or near maximum breadth of its during predetermined days in summer; resulting in the admission of sunshine in winter and the blocking of sunshine in summer. During the spring period winter, sunshine is gradually replaced by summer shade, and during the autumn period, summer shade is replaced by winter sunshine, such that the sunshade elements provide effective blocking and admission of sunshine to the shade area over the annual solar cycle.

12 Claims, 7 Drawing Sheets

(56) References Cited

U.S. PATENT DOCUMENTS

| | | | | |
|---|---|---|---|---|
| 6,105,318 | A * | 8/2000 | Harrison | E06B 9/24 52/200 |
| 2002/0008915 | A1 | 1/2002 | Koster | |
| 2019/0040679 | A1 | 2/2019 | Sembely | |

FOREIGN PATENT DOCUMENTS

| | | | | |
|---|---|---|---|---|
| AU | 2017101775 | A4 * | 2/2018 | E04F 10/08 |
| WO | WO2017/017353 | A1 | 2/2017 | |

OTHER PUBLICATIONS

Australian Patent Office (IPEA), International Preliminary Report on Patentability for PCT/AU2018/051092 dated Feb. 17, 2020, pp. 1-72.

* cited by examiner

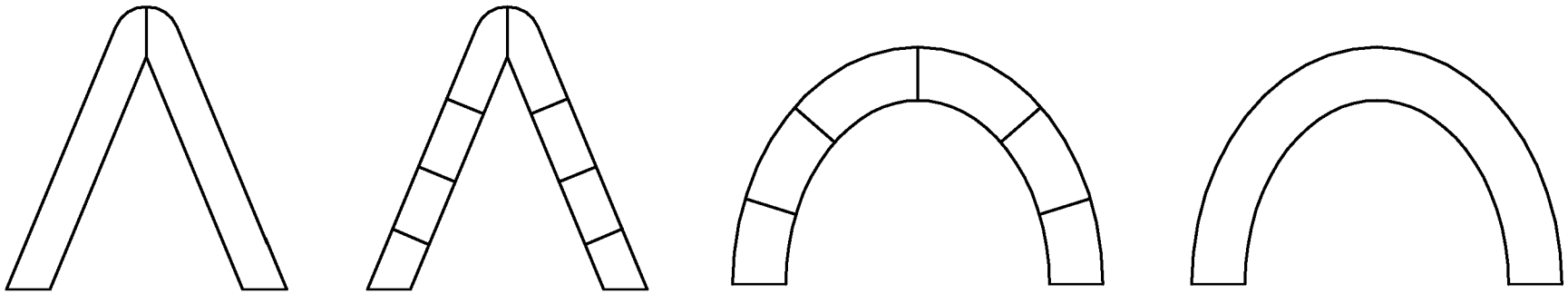
Fig. 2a
Unitary
Fig. 2b
Segmented
Fig. 2c
Segmented
Fig. 2d
Analogue
Full Arch Embodiments
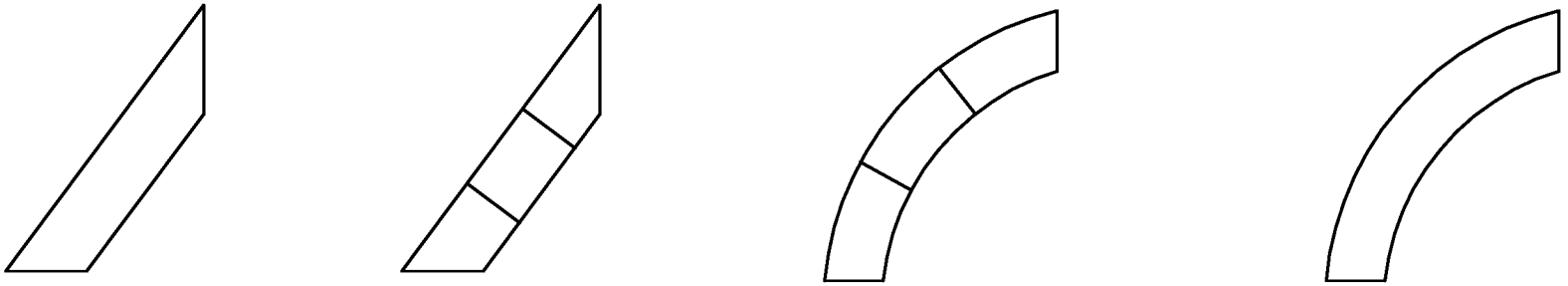
Fig. 2e
Unitary Arm
Fig. 2f
Segmented Arm
Fig. 2g
Segmented Arm
Fig. 2h
Analogue Arm
Half Arch Embodiments

SUNSHADE AND A METHOD OF CONSTRUCTING A SUNSHADE

CROSS-REFERENCE TO RELATED PATENT APPLICATIONS

The present application is a U.S. national stage application under 35 U.S.C. § 371 of PCT Application No. PCT/AU2018/051092, filed Oct. 10, 2018. The disclosure of the aforementioned priority application is incorporated herein by reference in its entirety.

FIELD OF THE INVENTION

The present invention relates to sunshades and methods of constructing sunshades, particularly, sunshade canopies installed at a fixed location in the temperate zones.

BACKGROUND OF THE INVENTION

Any discussion of the prior art throughout this specification should in no way be considered as an admission that such prior art is widely known or forms part of the common general knowledge in the field.

FIG. 1 illustrates the path of the Sun over the course of a day in mid-winter and mid-summer over the course of a year at latitude 34 degrees south.

Over the course of a day in the temperate zones, shadows move continuously as the Sun passes from east to west:

- morning shadows fall in a westerly direction and are quite long,
- midday shadows fall in the direction away from the equator and will be close beneath the object and are short,
- afternoon shadows fall in an easterly direction and are again, longer.

Solar noon is the time of day when the Sun is at its highest point in the sky and is located at true north. This is also the time when UV radiation levels are at their highest. Solar noon occurs around 1.00 pm during daylight saving time and around 12 noon at other times of the year.

The Sun's path also gradually changes throughout the year and so shadows vary according to the season. During the winter months the Sun rises to the north of east and sets to the north of west and stays relatively low in the sky. During the summer months the Sun rises to the south of east and sets to the south of west and is higher in the sky. The degree of these changes depends on latitude.

Four particular days of the year are important for understanding the Sun's annual path:

- on or around 21$^{st}$ March and 23$^{rd}$ September, when day and night are of equal length (the equinoxes)
- on or around 21$^{st}$ June, this being the shortest day of the year in the Southern Hemisphere (the winter solstice), and
- on or around 22$^{nd}$ December, this being the longest day of the year in the Southern Hemisphere (the summer solstice).

Australian Patent No. 600371 entitled "Improved Pergola" to Baverstock, and Australian Patent No. 642550 entitled "Glazing panel and method of manufacture" to Paolino, are two examples of prior art sunshades.

AU600371 employs slats of considerable thickness, which reduce the passage of sunshine and results in low efficiency. In particular, AU600371 does not take into consideration the three dimensional movements of the Sun, with the result that the efficiency of sunshine admission peaks at noon but falls off sharply before and after noon over the annual solar cycle.

AU642550 uses exceptionally thin slats and thereby improves sunshine admission efficiency compared to AU600371 and other similar devices. However, it suffers the same deficiency as AU600371 and other known devices in failing to maintain efficiency of sunshine admission before and after noon over the annual solar cycle.

Moreover, these prior art sunshades are horizontal slat devices and so cannot be integrated to form part of a sloping roof, or respond to the three dimensional movements of the Sun.

It therefore is an object of the present invention to overcome or ameliorate at least one of the disadvantages of the prior art, or to provide a useful alternative.

For the purposes of the present specification, the following terms have the meanings indicated:

Altitude: an angle above the horizontal.

Azimuth: horizontal angular position about a point on the earth from true north.

Diurnal solar path: the path of the Sun in the sky viewed from a point on the earth during a day.

Element a unit of a sunshade, usually a full-arch, sometimes a half-arch (or arm). An element is embodied with all the parameters to function as a sunshade according to this new design. Typically, a sunshade consists of multiple elements in the form of an array of interconnected arches.

Radiation: Any frequency of the electromagnetic spectrum reaching Earth from outer space.

Shade area: an area defined by the shade cast by a sunshade element, comprised of an infinite number of shade points.

Shade point a point of shade falling within a shade area.

Slat inclination: the angle of the longitudinal axis of slat arms of an arch to the horizontal.

Sunlight indirect solar radiation reaching an area.

Sun/shade cut-off expressed as an angle or date. On a particular selected date (usually in spring and autumn) when the Sun reaches a predetermined angle, full sunshine will be cut off in spring and full shade will be cut off in autumn.

Sunrise-to-noon and noon-to-sunset inclination angle/chord: the angle or chord formed when an imaginary line is drawn between the point where the Sun rises or sets and the point at which the Sun reaches its zenith at noon.

Sunshine: direct solar radiation reaching an area.

Tilt; Slat tilt the lateral slat arm angle to the horizontal and the various angles thus formed at every point along the slat arm which are substantially equal to the angle of the altitude of the solar path at the corresponding azimuth on a particular nominated day of the year.

Width-ratio: the ratio between the width of a slat and the width of its adjacent aperture(s).

SUMMARY OF THE INVENTION

In a first aspect of the invention, there is provided a sunshade element having a reference shade point in a shade area, the sunshade element being configured such that the sunshade element is viewed from the reference shade point as a thin profile between adjacent apertures approximating a reference solar path, the reference solar path being the diurnal solar path viewed from the reference shade point over predetermined days in winter, thereby maximising the admission of sunshine to the shade area;

the sunshade element being configured such that the sunshade element presents the maximum or near maximum breadth of its face when it is viewed from the reference shade point during predetermined days in summer and appears as a broad arc approximating the reference band of diurnal solar paths occurring over a predetermined period in summer, thereby providing blocking of sunshine to the shade area;

thus resulting in the admission of sunshine in winter and the blocking of sunshine in summer, and wherein during the spring period winter sunshine is gradually replaced by summer shade and during the autumn period summer shade is replaced by winter sunshine, such that the sunshade elements provide effective blocking and admission of sunshine to the shade area over the annual solar cycle.

Preferably, the sunshade element approximates a portion of a surface defined by straight lines extending between the reference shade point and the reference solar path.

Preferably, the sunshade element is configured to block sunshine to the shade area over predetermined days in summer.

In one embodiment, the sunshade element is a V shaped arch having a slat width substantially normal to an arch slat length, the slat width at each point along the arch slat length being aligned substantially along a straight line defined between a respective point along the reference solar path and the reference shade point, such that the slat width at each point along the arch slat length is tilted at a critical angle substantially equal to the angular altitude of the respective point along the reference solar path.

To determine the azimuth of each arm of the V-shaped sunshade element, the longitudinal axis of the eastern arm is oriented so as to be parallel to the azimuth line between true north and the point of sunrise on the horizon in mid winter. For example, in the case of Sydney in mid-winter the azimuth line runs from 0° (true north) to typically around 64°. The longitudinal axis of the eastern slat arm is oriented so as to be parallel to this azimuth line. The second (western) arm is oriented such that its longitudinal axis is parallel to the line drawn between 0° (true north) and the point of sunset on the horizon (for Sydney in mid-winter, 297°).

To calculate the slat arm azimuth apply the formula:

$$Sl \cdot az = \frac{Sr \cdot az^{\circ}}{2} + 90^{\circ}$$

$$Sl \cdot az = \text{Slat azimuth } ^{\circ}$$

$$Sr \cdot az = \text{Sunrise } asimuth \ ^{\circ}$$

To determine the inclination angle of a slat arm the sunrise (or sunset) to noon angle (θ) must be calculated. The following formula provides a means of closely approximating the angle (θ) to the horizon of a line joining the point at which the Sun rises and the point where it is at its maximum altitude during the day:

$$\sin\theta = \frac{\cos(\delta - \phi)}{\cos\delta \cdot \sqrt{2} \cdot (1 + \tan\delta \cdot \tan\phi)^{1/2}}$$

To use this formula you need to know your latitude (ϕ) and the Sun's declination (δ). This latter quantity varies between +23.5° in winter in the southern hemisphere and −23.5° in summer in the southern hemisphere, and is zero at the two equinoxes.

In another embodiment, the sunshade element is adjustable to dynamically block and admit sunshine to the shade area over the diurnal and annual solar cycles. Preferably, at least one of the critical angles is adjustable.

In some embodiments, the sunshade element is manually adjustable. Preferably, the sunshade element is remotely adjustable. In other embodiments, the sunshade element is automatically adjustable.

Thus, although the sunshade element is statically close to optimum in blocking and admitting sunshine to the shade area over the diurnal and annual solar cycles, the sunshade element may be finely adjustable to dynamically optimise the desired blocking and admission of sunshine over the diurnal and annual solar cycles, if so desired.

In a second aspect of the invention, there is provided a sunshade where each element includes a plurality of segments, being spaced thereby to maximise the admission of sunshine through each aperture between adjacent sunshade elements to the shade area over predetermined days in winter, and to block sunshine to the shade area over predetermined days in summer, such that the sunshade provides effective blocking and admission of sunshine to the shade area over the annual solar cycle.

Preferably, the sunshade elements are substantially identical. Preferably, the sunshade elements are spaced uniformly apart. Preferably, each sunshade element has a substantially uniform width. Preferably, each aperture has a substantially uniform width. Preferably, the width of a sunshade element and the width of a aperture are both selected to define a width-ratio such that the sunshade elements block sunshine to the shade area over predetermined days in summer.

In another embodiment, the sunshade element includes one or more slat segments, each having a nominal slat width substantially normal to a nominal slat length:

the nominal slat width of each slat segment being aligned substantially along a straight line defined between a respective point along the reference solar path and the reference shade point, such that the nominal slat width is tilted at a critical angle substantially equal to the angular altitude of the respective point along the reference solar path; and the nominal slat segment length being substantially parallel to the tangent to the reference solar path at the respective point along the reference solar path.

In another variation, the sunshade element includes a plurality of the slat arms interconnected. The plurality of slat arms thereby forms an array of arches.

In yet another variation, representing a basic form of the invention, the sunshade element includes two of the interconnected slat segments. In a variation to this basic form of the invention, where the shade area is adjacent a structure, the sunshade element includes one of the slat segments, arranged such that the sunshade element cooperates with the structure to effectively block and admit sunshine to the shade area over the annual solar cycle.

Since the nominal slat width of each slat segment is aligned substantially along a straight line defined between a respective point along the reference solar path and the reference shade point, the nominal slat segment length is aligned along a corresponding azimuth. Since the nominal slat length of each slat segment is substantially parallel to the tangent to the reference solar path at the respective point along the reference solar path, the nominal slat segment length is inclined at a corresponding inclination angle.

In a third aspect of the invention, there is provided a method of constructing a sunshade, the method including the steps of:

providing a sunshade element having a reference shade point in a shade area, as described above;

configuring the sunshade element such that the sunshade element is viewed from the reference shade point as a thin profile between adjacent apertures approximating a reference solar path, the reference solar path being the diurnal solar path viewed from the reference shade point over predetermined days in winter, thereby maximising the admission of sunshine to the shade area; and configuring the sunshade element to block sunshine to the shade area over predetermined days in summer, such that the sunshade element provides the desired blocking and admission of sunshine to the shade area over the annual solar cycle.

Preferably, the sunshade element is configured to approximate a portion of a surface defined by straight lines extending between the reference shade point and the reference solar path.

Preferably, a plurality of the sunshade elements are provided, and the method includes the step of spacing the sunshade elements apart from each other, thereby to maximise the admission of sunshine through each aperture between adjacent sunshade elements to the shade area over the predetermined days in winter, and to block sunshine to the shade area over predetermined days in summer, such that the sunshade effectively blocks and admits sunshine to the shade area in summer.

Preferably, the sunshade elements are substantially identical. Preferably, the sunshade elements are spaced uniformly apart. Preferably, each sunshade element has a substantially uniform width. Preferably, each aperture has a substantially uniform width. Preferably, the method includes the step of selecting both the width of a sunshade element and the width of a aperture to define a width-ratio such that the sunshade elements block sunshine to the shade area in summer.

In one embodiment, each sunshade element is an arcuate slat having a slat width substantially normal to an arcuate slat length, and the method includes the step of aligning the slat width at each point along the arcuate slat length substantially along a straight line defined between a respective point along the reference solar path and the reference shade point, such that the slat width at each point along the arcuate slat length is tilted at a critical angle substantially equal to the angular altitude of the respective point along the reference solar path.

In another embodiment, each sunshade element includes one or more slat segments, each having a nominal slat width substantially normal to a nominal slat length, and the method includes the steps of:

aligning the nominal slat width of each slat segment substantially along a straight line defined between a respective point along the reference solar path and the reference shade point, such that the nominal slat width is tilted at an angle substantially equal to the angular altitude of the respective point along the reference solar path; and positioning the nominal slat segment length substantially parallel to the tangent to the reference solar path at the respective point along the reference solar path.

Since the nominal slat width of each slat segment is aligned substantially along a straight line defined between a respective point along the reference solar path and the reference shade point, the nominal slat segment length is aligned along a corresponding azimuth.

Since the nominal slat length of each slat segment is substantially parallel to the tangent to the reference solar path at the respective point along the reference solar path, the nominal slat segment length is inclined at a corresponding inclination angle.

In a variation representing a basic form of the invention, the sunshade element includes two of the interconnected slat arms. In a variation to this basic form of the invention, where the shade area is adjacent a structure, the sunshade element can comprise a single slat arm, and the method includes the step of arranging each sunshade element such that each sunshade element cooperates with the structure to provide effective blocking and admission of sunshine to the shade area over the annual solar cycle.

The method includes selecting a predetermined day in mid-winter at the shade location.

In another embodiment, the method includes the step of adjusting the sunshade element to dynamically optimise the desired blocking and admission of sunshine to the shade area over the diurnal and annual solar cycles. Preferably, the method includes the step of adjusting at least one of the critical angles. The method includes the step/s of adjusting the slat tilt angle, the azimuth angle of the arch arm longitudinal axis, the inclination angle of the longitudinal arm axis and/or the sun/shade cut-off angle.

In some embodiments, the sunshade element is manually adjusted. Preferably, the sunshade element is remotely adjusted. In other embodiments, the sunshade element can be configured to automatically adjust in response to the diurnal and annual solar cycles.

Thus, although the sunshade elements are statically near optimum in blocking and admitting sunshine to the shade area over the diurnal and annual solar cycles, the sunshade elements may be adjusted to dynamically optimise the desired blocking and admission of sunshine over the diurnal and annual solar cycles, if so desired.

Advantageously, a sunshade according to the present invention simultaneously admits sunshine through both vertical and horizontal planes. In comparison, previously known sunshades admit sunshine either through a vertical or horizontal plane only, but not through both planes simultaneously.

The admittance or blocking of sunshine may be achieved at a point at any angle or between any two angles of altitude at a nominated time and duration. Likewise, at a point, at any angle or between any two angles of azimuth. Thus, a sunshade or more particularly a device for some other particular application using the same fundamental design principles can admit or block radiation emanating from outer space at any point or area of the hemispherical dome.

BRIEF DESCRIPTION OF THE FIGURES

One or more preferred embodiments of the invention will now be described, by way of example only, with reference to the accompanying figures, in which:

FIGS. 2*a* to 2*h* illustrate various embodiments of the sunshade elements which can form the sunshade according to the invention, including full arch embodiments (FIGS. 2*a* to 2*d*) and half arch embodiments (FIGS. 2*e* to 2*h*).

DESCRIPTION OF PREFERRED EMBODIMENTS OF THE INVENTION

Figure 1:
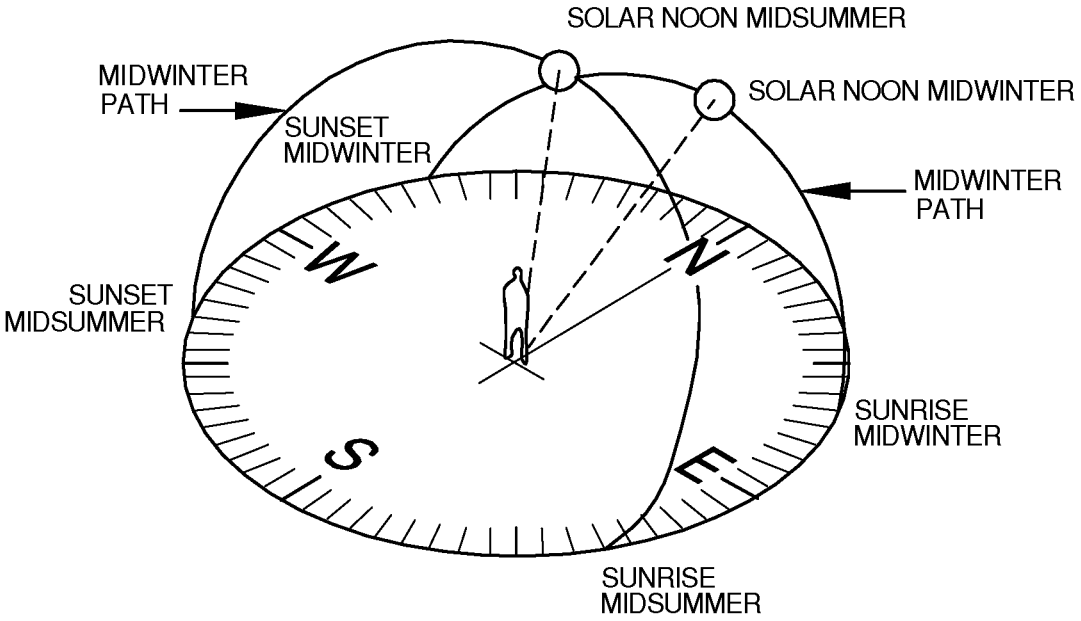
FIG. 1 illustrates the path of the Sun over the course of a day in mid-winter and mid-summer over the course of a year at latitude 34 degrees south.
Figure 3A:
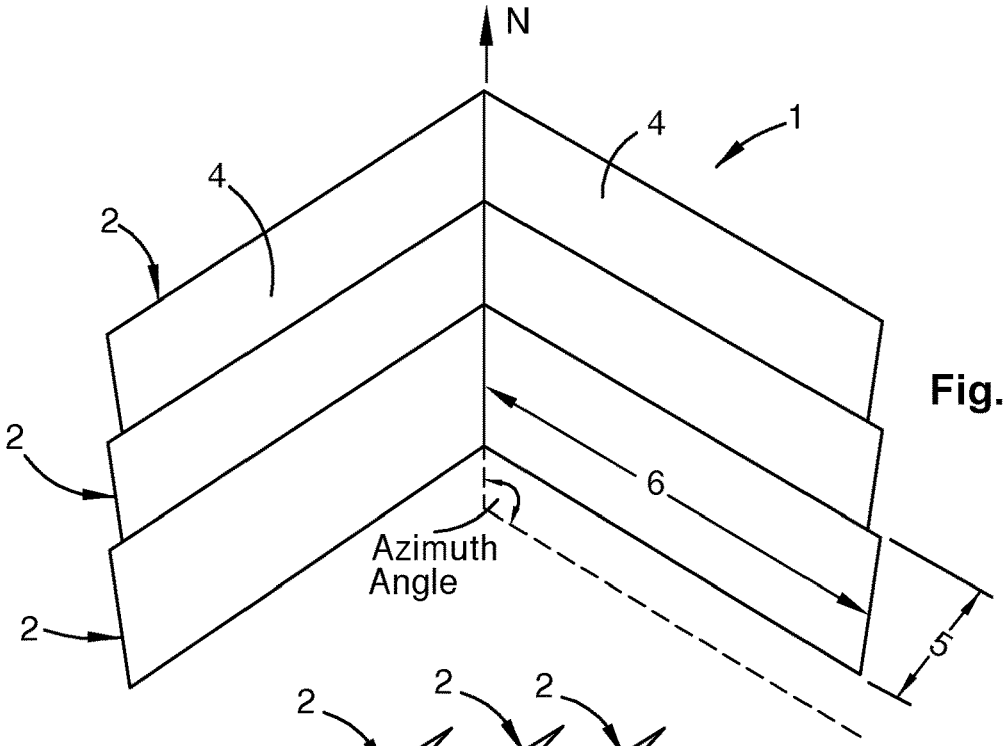
FIG. 3*a* is a plan view of a first preferred embodiment of a sunshade according to the present invention.
Figure 3B:
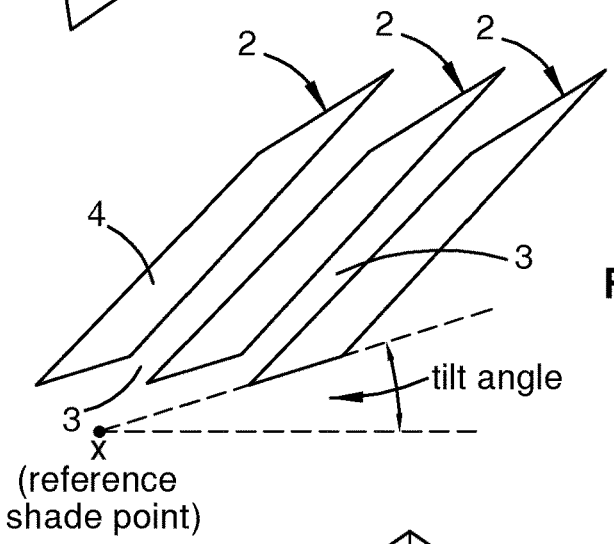
FIG. 3*b* is a side elevation view of the sunshade depicted in FIG. 3*a;*
Figure 3C:
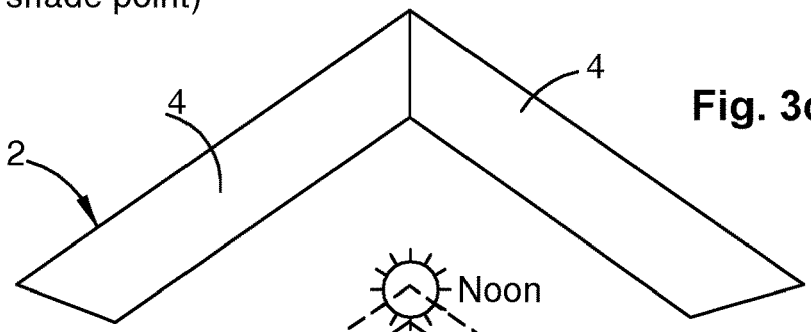
FIG. 3*c* is an end elevation view of the sunshade depicted in FIG. 3*a;*

Referring to the embodiment of the sunshade 1 depicted in FIGS. 3*a* to 3*c*, the sunshade includes a plurality of spaced sunshade elements 2. Each sunshade element 2 has a reference shade point in a shade area. Each sunshade element 2 is configured such that each sunshade element 2 is viewed from the reference shade point as a thin profile between adjacent apertures approximating a reference solar path, the reference solar path being the diurnal solar path viewed from the reference shade point over predetermined days in winter, thereby maximising the admission of sunshine through each aperture 3 between adjacent sunshade elements 2 to the shade area over the predetermined days. The sunshade element 2 is also configured to block sunshine to the shade area in summer, such that the sunshade 1 provides effective blocking and admission of sunshine to the shade area over the annual solar cycle.

Each sunshade element 2 approximates a portion of a surface defined by straight lines extending between the reference shade point and the reference solar path (see, for example, FIG. 3*b*).

Figure 3D:
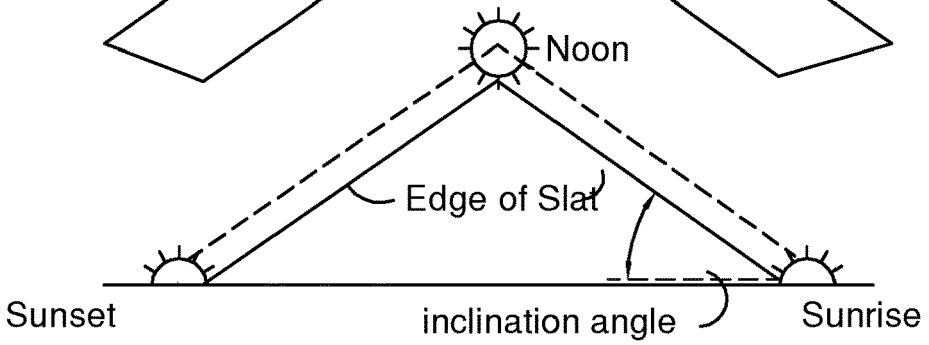
FIG. 3*d* is a view of the sunshade when viewed from the reference shade point in respect of the tilt angle of the slat.

In the embodiment shown in FIGS. 3*a* to 3*c*, each sunshade element 2 includes two interconnected slats or arms 4, each having a nominal slat width 5 substantially normal to a nominal slat length 6. The nominal slat width 5 of each slat is aligned substantially along a straight line defined between a respective point along the reference solar path and the reference shade point this slat alignment being the tilt angle, (see FIG. 3*b*). The nominal slat length 6 (see FIG. 3*a*) is inclined at the sunrise to noon inclination angle (see FIGS. 3*c* and 3*d*)

Thus, each sunshade element 2 forms an inclined arch, and the plurality of sunshade elements 2 form an array 1 of inclined arches parallel to each other. The ridge of a series of arches runs in a generally north-to-south direction. In plan view, each arch 2 forms a V- or rotated V-shape (see FIG. 3*a*). A pair of slats 4 form two arms of an arch 2 which can be referred to as the eastern and western slats (or arms) respectively. Each arch 2 is spaced from its neighbour by an aperture 3 (see FIG. 3*b*).

In this embodiment, the nominal slat width 5 of each slat arm 4 is aligned substantially along a straight line defined between a respective point along the reference solar path and the reference shade point (see FIG. 3*b*), and the nominal slat length is aligned along a corresponding azimuth (see, for example, FIG. 3*a*). Since the nominal slat length 6 of each slat arm 4 is substantially parallel to the tangent to the reference solar path at the respective point along the reference solar path, the nominal slat length 6 of each slat arm is inclined at the inclination angle of the corresponding tangent (see, for example, FIG. 3*d*).

Figure 4A:
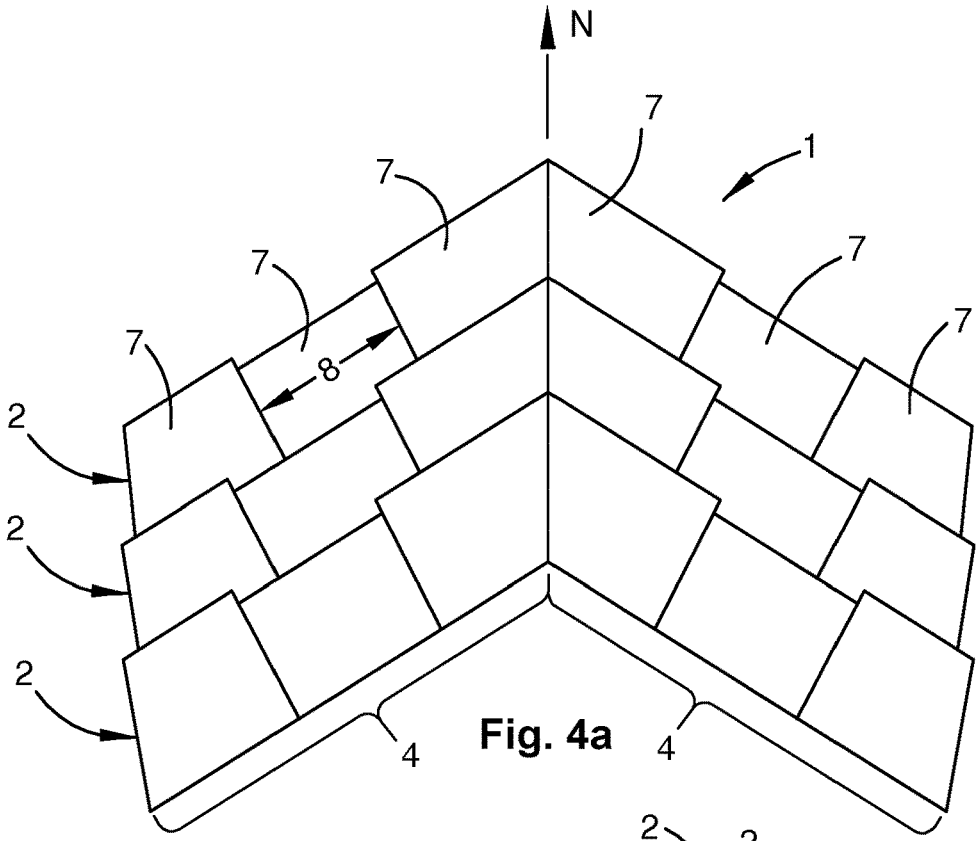
FIG. 4*a* is a plan view of a second preferred embodiment of a sunshade according to the present invention.
Figure 4B:
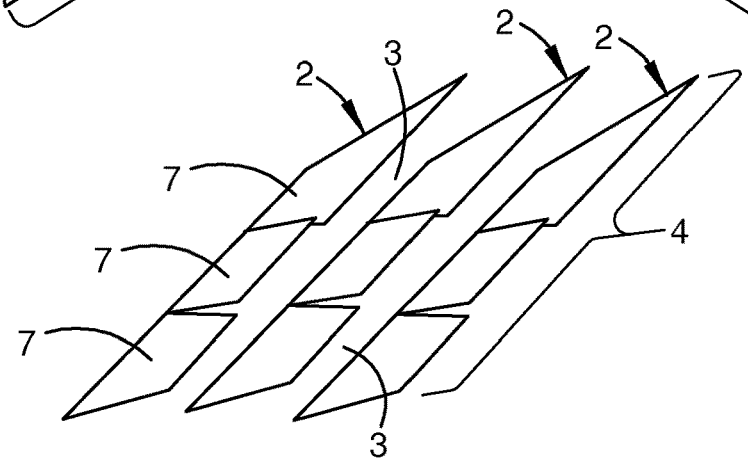
FIG. 4*b* is a side elevation view of the sunshade depicted in FIG. 4*a;*
Figure 4C:
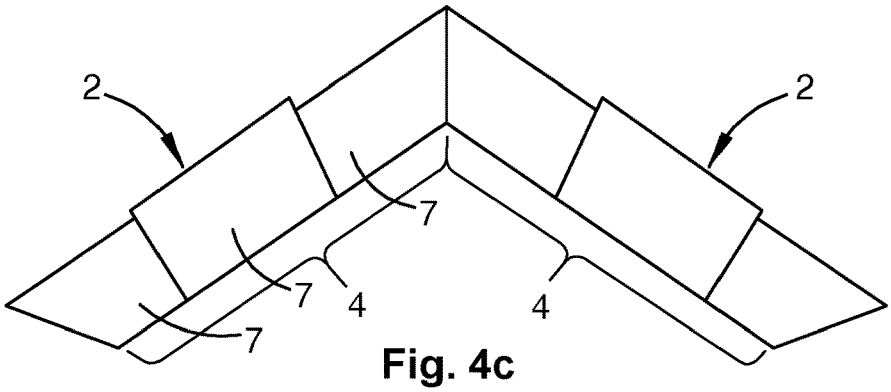
FIG. 4*c* is an end elevation view of the sunshade depicted in FIG. 4*a;*

In a second embodiment, as shown in FIGS. 4*a* to 4*c*, each sunshade element 2 is formed by two interconnected slats or arms 4 comprised of interconnected segments 7 of segment length 8. For simplicity and clarity the minimum number of slat segments is shown in the embodiment of FIGS. 4*a* to 4*c*.

Figure 5A:
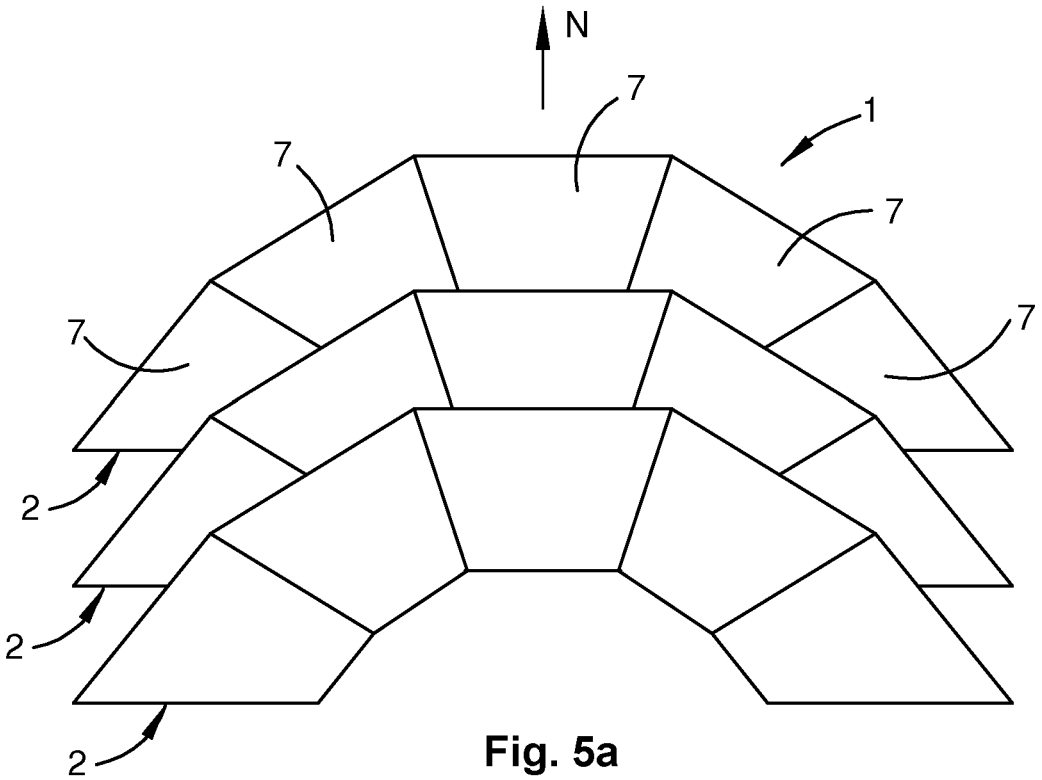
FIG. 5*a* is a plan view of a third preferred embodiment of a sunshade according to the present invention.
Figure 5B:
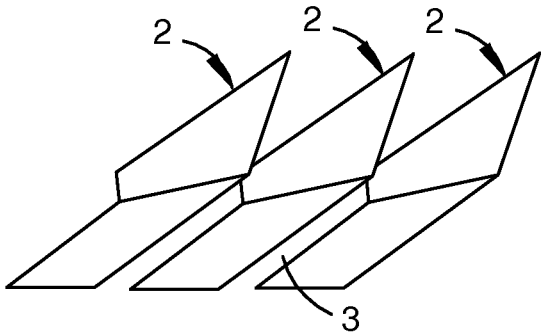
FIG. 5*b* is a side elevation view of the sunshade depicted in FIG. 5*a;*
Figure 5C:
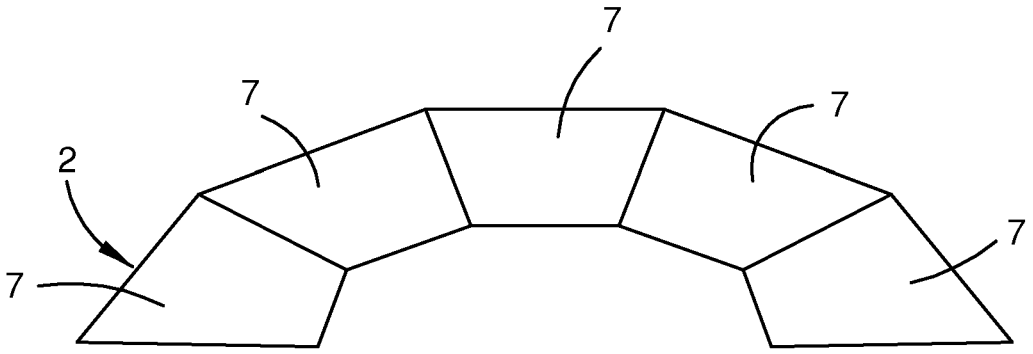
FIG. 5*c* is an end elevation view of the sunshade depicted in FIG. 5*a;*

In the third arcuate embodiment utilising a plurality of slat segments, FIGS. 5*a* to 5*c*, the slat segments combine to form a segmented arcuate shape or profile. It will be appreciated that the more slat segments there are, the closer the segmented arcuate slat approximates an analogue arcuate slat. Again, for simplicity and clarity the minimum number of slat segments is shown in the embodiment of FIGS. 5*a* to 5*c*.

Figure 6A:
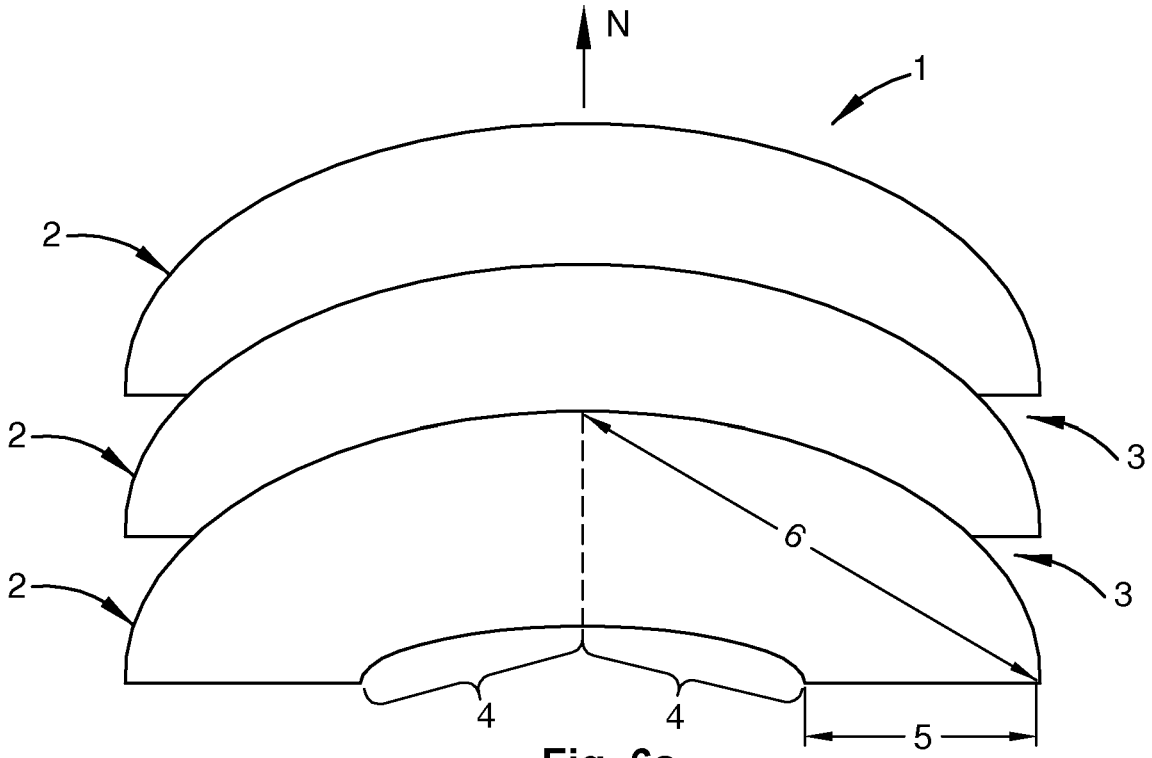
FIG. 6*a* is a plan view of a fourth preferred embodiment of a sunshade according to the present invention.
Figure 6B:
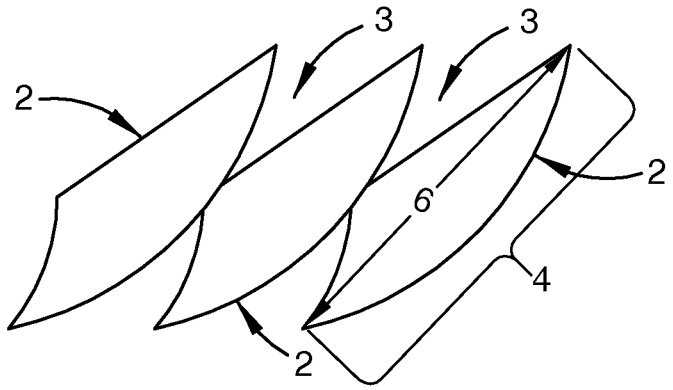
FIG. 6*b* is a side elevation view of the sunshade depicted in FIG. 6*a;*
Figure 6C:
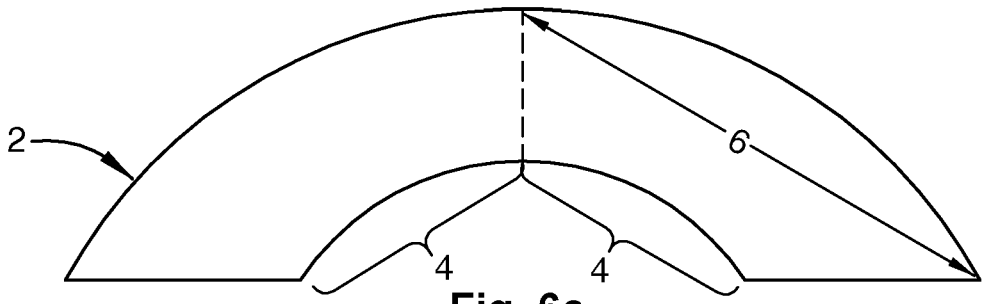
FIG. 6*c* is an end elevation view of the sunshade depicted in FIG. 6*a*.
Figure 7:
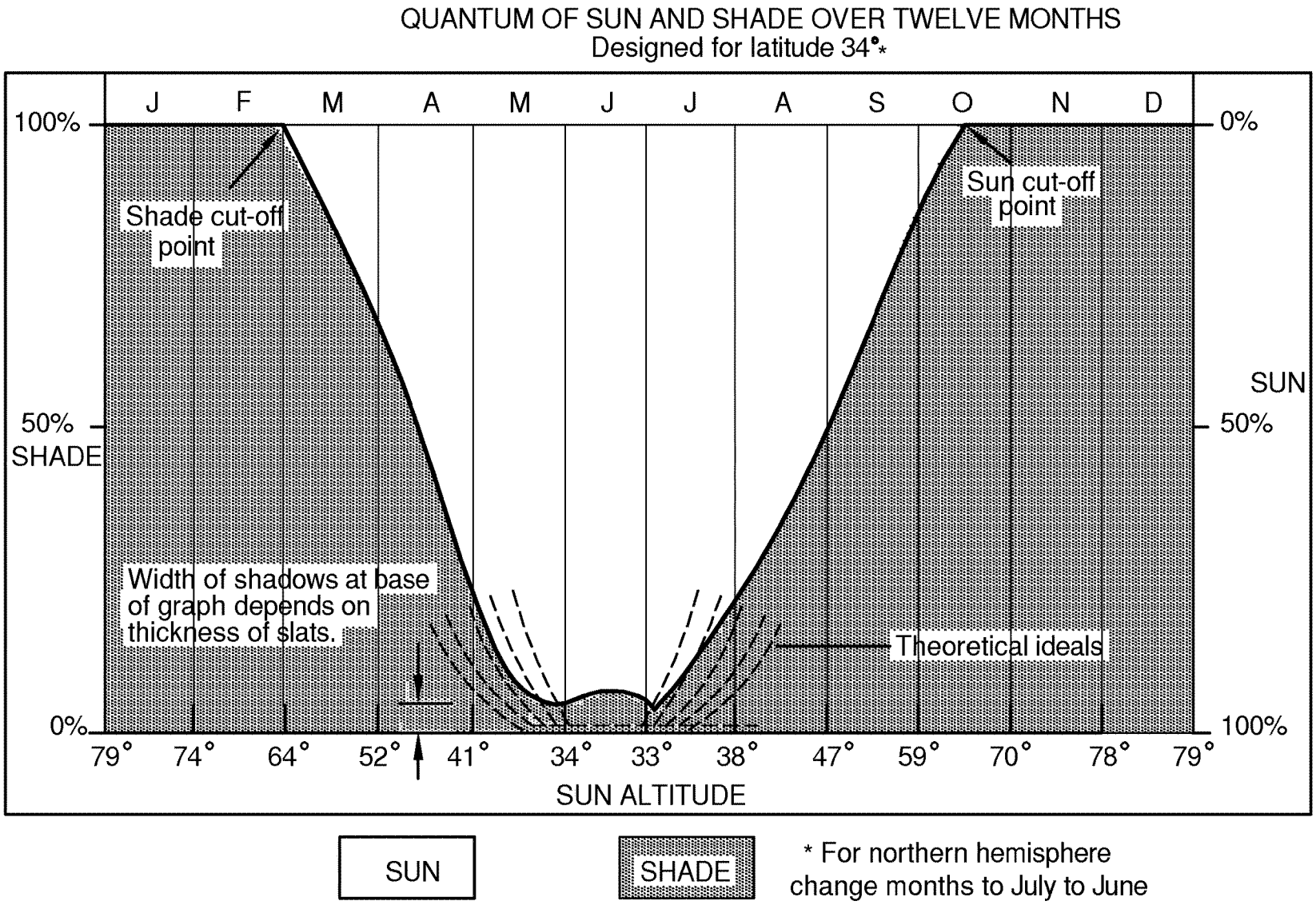
FIG. 7 illustrates the quantum of sunshine and shade provided by an embodiment of the sunshade according to the invention, over a twelve month period at latitude of 34 degrees south.

In a fourth, particularly efficient, embodiment, as shown in FIGS. 6*a* to 6*c*, each sunshade element 2 is a slat forming an analogue arcuate arch having a slat width 5 substantially normal to an arcuate slat length 6. The slat width 5 at each point along the arcuate slat length 6 is aligned substantially along a straight line defined between a respective point along the reference solar path and the reference shade point, such that the slat width 5 at each point along the arcuate slat length 6 is tilted at a critical angle substantially equal to the angular altitude of the respective point along the reference solar path. Unlike the embodiments utilising slat segments, it will be appreciated that there will be an infinite number of points along the arcuate slat length 6, an infinite number of points along the solar path, and an infinite number of straight lines, each passing through the slat width at corresponding points along the arcuate slat length arm and a corresponding respective point along the solar path.

Thus, each arcuate slat 2 forms a continuous arc, the profile of which, when viewed from the reference shade point, closely approximates the reference solar path. Each arcuate slat 2 also closely approximates a portion of the surface defined by straight lines extending between the reference shade point and the reference solar path.

Each sunshade element 2 in the fourth embodiment is physically a single, continuous entity, although conceptually it is desirable to consider it as a two armed element formed by two connected segments 4.

In the embodiments described above, it will be appreciated that although each sunshade element, when viewed from the reference shade point, approximates the reference solar path to varying degrees, each sunshade element minimises it profile to the sunrays in winter, thereby maximising the admission of sunshine to the shade area in winter. Similarly, it can be seen that each sunshade element approximates, albeit to varying degrees, a portion of the surface defined by straight lines extending between the reference shade point and the reference solar path.

In the above embodiments, the sunshade elements 2 are substantially identical, each with a substantially uniform width. The sunshade elements are spaced uniformly apart, with each aperture 3 having a substantially uniform width. The width of the each sunshade element, being the nominal slat width 5, and the width of each aperture 3 define a width-ratio. The width-ratio is selected such that, viewed from particular directions, the sunshade elements overlap, thereby blocking sunshine to the shade area in summer.

In one embodiment, for example, the predetermined day for maximum sunshine admission is selected in mid-winter at the shade location. Thus, on this day, the apertures admit the maximum sunshine to the shade area and maximum or near maximum immediately before and after this selected date. Following winter, the area of shade will increase each day until the sun-shade cut-off date is reached, this is achieved by the selection of a width-ratio such that, in late spring, the overlapping spaced sunshade elements block sunshine completely at noon thereby, providing full shade. This will obtain throughout the heat of summer. In autumn on a particular day when the altitude of the Sun, equals the nominated altitude of the spring sun-blocking altitude, the shade will become unblocked, the apertures then become sunshine admitting: admitting the first slit of sunshine to the shade area. Then, on each following day, the area of shade will decrease until early winter when sunshine is admitted throughout the whole day and continues throughout a period in winter. Thus, in spring and autumn, the sun-to-shade ratio to the shade area continually changes.

The embodiments having a plurality of spaced sunshade elements that overlap when viewed from particular directions advantageously allow sunshade elements of a variety of widths to be used, together with a variety of widths for the spaces, to effectively block and admit sunshine to the shade area over the annual solar cycle. However, by selecting a suitable slat-to-aperture width-ratio, the desired blocking and admission of sunshine to the shade area over the annual solar cycle can be optimised, for shade areas of unlimited proportions.

In a variation of all embodiments, however, the sunshade 1 includes only one sunshade element 2, being one single arch.

In these variations having only one sunshade element 2, it will be appreciated that the one sunshade element 2 still blocks and admits sunshine to the shade area over predetermined portions of predetermined diurnal solar cycles, and thereby, a predetermined portion of the annual solar cycle. These variations are particularly suited to a shade area of relatively small proportions.

In another variation of all the embodiments, the shade area is adjacent a structure. In this variation of a basic form of the invention, each sunshade element includes just one slat arm 4 (half-arch), arranged such that the sunshade element 2 cooperates with the structure to provides effective blocking and admission of sunshine to the shade area over the annual solar cycle. For example, the sunshade may be positioned on the eastern or western slope of a hip roof to provide coverage over a skylight. Therefore, the skylight, being the shade area in this case, would only be exposed to approximately one half of the diurnal cycle, and would only require one slat arm 4 to provide adequate coverage. In another example, the sunshade is applied as an awning on the eastern side of a tall building. In other words, the full-arch sunshade described in the initial first embodiment is applied to situations where sunshine is available throughout most of the day, whilst the half-arch sunshade of this present variation is used in situations where only morning or afternoon sunshine is available.

In all the embodiments the slats orientation and their position relative to each other are determined by four variable critical angles. These angles are: the slat tilt angle, the slat inclination angle, the slat azimuth angle and the sun/shade cut-off angle.

Varying these parameters in embodiments allows for the application and optimisation of the sunshade of the present invention to a large variety of sunshine blocking and admission schemes over the annual solar cycle for different latitudes. The degree of sunshine or shade cast below the sunshade onto the shade area at any particular time of the day or the year can be predetermined by careful variation of these parameters.

Once these parameters have been selectively applied to the sunshade, it is statically near optimum in blocking and admitting sunshine to the shade area over the diurnal and annual solar cycles. However, in some embodiments, each sunshade arm 4 can be adjustable to dynamically optimise the desired blocking and admission of sunshine to the shade area over the diurnal and annual solar cycles, particularly applicable when an unseasonable day or period occurs. In these embodiments, at least one of the critical angles is preferably adjustable. In some embodiments, each arm 4 of the sunshade element 2 is manually adjustable. Preferably, each sunshade element arm 4 is remotely adjustable. In other embodiments, each sunshade element arm 4 is automatically adjustable.

In one particular embodiment the sunshade may include slats with an adjustable (extendible and retractable) edge portion which can be moved to adjust the effective width of the slats. By adjusting the effective width of the slats the sun/shade cut-off date can be controlled.

Since the orientation of the sunshade elements is already statically close to the optimum, any desired adjustability would be slight. The adjustability can be built into the sunshade by many means. For example, more attachment points for the sunshade elements arm 4 can be added. The sunshade elements arm 4 can be attached via pivots or hinges. The sunshade elements arms 4 can be remotely or automatically adjusted using motors and articulated joints. Ideally, in a practical sunshade, all of the parameters would be adjustable viz. the slat tilt angle, the slat inclination angle, the azimuth angle and the slat aperture width. Adjustments to the performance characteristics of the device could then be made for the long-term, the short term or immediately.

For embodiments of the sunshade 1 described above having only one of the sunshade elements 2, the method includes the steps of:

providing the one sunshade element 2 having a respective reference shade point in the shade area;

configuring the sunshade element 2 such that the sunshade element 2 is viewed from the reference shade point as a thin profile between adjacent apertures approximating the reference solar path, the reference solar path being the diurnal solar path viewed from the reference shade point in winter, thereby maximising the admission of sunshine to the shade area; and configuring the sunshade element 2 to block sunshine to the shade area over predetermined days in summer, such that the sunshade element 2 provides effective blocking and admission of sunshine to the shade area over the annual solar cycle.

Each sunshade element 2 is configured to approximate a portion of the surface defined by straight lines extending between the reference shade point and the reference solar path.

In embodiments where each sunshade arm 4 is divided into segments 7, each having a nominal slat width 5 substantially normal to a nominal slat segment length 8, the method includes the steps of:

aligning the nominal slat width 5 of each slat segment 7 substantially along a straight line defined between the respective point along the reference solar path and the reference shade point, such that the nominal slat width 5 is tilted at an angle substantially equal to the angular altitude of the respective point along the reference solar path; and positioning the nominal slat segment length 8 substantially parallel to the tangent to the reference solar path at the respective point along the reference solar path.

In embodiments where each pair of sunshade slat arms 4 forms an arch having a slat width 5, the method includes the step of aligning the slat width 5 at each point along the arcuate slat length 6 substantially along a straight line defined between the respective point along the reference solar path and the reference shade point, such that the slat width 5 at each point along the arcuate slat length 6 is tilted at an angle substantially equal to the angular altitude of the respective point along the reference solar path.

In embodiments having a plurality of the sunshade elements 2, the method includes the step of selecting both the width of a sunshade element 2 and the width of a aperture 3 to define a width-ratio such that the sunshade elements 2 block sunshine to the shade area in summer.

In the variation to the basic form of the invention described above, where the shade area is adjacent a structure, the method includes the step of arranging each sunshade element 2 such that it cooperates with the structure to optimise the desired blocking and admission of sunshine to the shade area over the annual solar cycle.

The method includes the step of selecting a predetermined day in mid-winter at the shade location area.

In embodiments where the sunshade arms 4 are adjustable, the method includes the step of adjusting each sunshade arm 4 to dynamically optimise the desired blocking and admission of sunshine to the shade area over the diurnal and annual solar cycles. The method preferably includes the step of adjusting at least one of the critical angles. In some embodiments, each sunshade arm 4 is manually adjusted. Preferably, each sunshade arm 4 is remotely adjusted. In other embodiments, each sunshade arm 4 is automatically adjusted.

By suitably spacing and orientating the sunshade elements 2, the amount of sunshine or shade provided to the shade area can be controlled and varied to suit the latitude, climate and the user's requirements. For example, the admission of sunshine for a sunshade designed for a location with a long hot summer can be provided with shade for a longer period during the year and also during the day than a cold mountain location, even though both locations are on the same latitude. In the preferred embodiments, the sunshade of the invention presents the least obstruction to the rays of the Sun at and about the time of winter solstice, while presenting complete obstruction to the direct rays of the Sun in summer. During spring and autumn, the sunshade elements 2 provide part sunshine and part shade. To achieve this with high efficiency the sunshade elements 2 must be appropriately spaced and oriented. In all embodiments, whether they have unitary slats or segmented slats 7, the tilt angles, the azimuth angles, the inclination angles and the sun/shade cut-off angles must be correctly determined.

Typically, in practice, the following information for the shade area is ascertained in order to carry out the method:

1. the latitude;
2. the angular altitude of the Sun at noon in mid-winter;
3. the azimuth of the rising and setting Sun in mid-winter;
4. the mean angular path of the reference solar path between sunrise and noon, and between noon and sunset in mid-winter; and
5. the angular altitude of the Sun at noon on the day from which blocking of sunshine is desired, so that the width-ratio can be determined.

Some of the advantages provided by the present invention include the following:

1. The ability to effectively and efficiently utilise the Sun's diurnal and annual azimuth movements.
2. The ability to effectively and efficiently utilise the Sun's diurnal and annual altitude movements.
3. The ability to provide abundant sunshine throughout winter.
4. The ability to provide abundant, sunshine during winter over the whole day (i.e. sunrise to sunset).
5. The ability to provide full shade each day in mid-summer while admitting abundant natural light.
6. The ability to admit abundant sunlight throughout the year, whilst screening out sunshine and other forms of solar radiation.
7. The ability to flood a covered area of virtually unlimited size with sunshine in winter while automatically (but passively) changing over to full shade in summer, while at the same time providing abundant natural light.
8. The ability to provide all the above advantages by passive (i.e. non-mechanised) means.
9. In applications where the highest degree of efficiency is required (i.e. close to 100%) in respect to shade and sunshine any time of the day or year: the ability to mechanise the invention so as to move the slats either manually or by power, wherein the movement required would be relatively slight because the slats are already near their optimum position statically, which would greatly simplify the manual or power system.
10. Low power requirements for changing the position of the sunshade elements;
11. The ability to adapt the invention to a number of alternative applications other than sunshades; and
12. The ability to have these advantages combined in one integrated structure.
13. The ability to apply the design to any latitude or climate.

Advantageously, the present invention enables the design and construction of a sunshade or canopy that functions as a passive device. A basic form of the canopy consists of a plurality of spaced slats arranged in a uniform formation. The slats are orientated so as to admit abundant sunshine in the winter while providing complete shade during the heat of summer. In spring and autumn the sunshine to shade ratio gradually changes as the following season approaches.

Prior art sunshade devices are inefficient and ineffective for a large part of the diurnal and annual solar cycles. The present invention ameliorates or eliminates the limitations of these previous devices. The invention enables the construction of sunshades to suit the latitude and the climate, and the function and needs of the user. The device is applicable to a wide variety of situations and structures. For example, it can be used to moderate temperatures in homes and other buildings and architectural structures for comfort and saving in energy costs. The invention provides protection from UV radiation in summer while still admitting abundant natural light. In winter the undercover area is flooded with sunshine throughout the day as long as the sun shines. This is ideal for swimming pools and playgrounds.

The sunshade of the present invention can be constructed over existing roofs, or built as an integral part of new roofs, of a variety of shapes, including: conventional flat, gable, hip, dome, and pyramid roofs. It may also be constructed as an attachment to a wall or to form the entire envelope of a house.

The invention aids the construction of energy efficient and environmentally friendly structures.

The sunshade of the present invention has many variations, so notwithstanding what has been said in the foregoing, the sunshade parameters and structural elements may be non-symmetrical and varied in scale. For example, the elements in an array may vary in size, a single element or a group of elements may vary one from another providing that the angles and the ratio of the relevant parameters remain the same.

The materials from which the sunshade is constructed can be varied in numerous ways in order to tailor its performance and/or aesthetics. For example, the sunshade elements may be opaque, semi-opaque. The material from which the sunshade may be constructed include wood, concrete, metal, plastic, glass, fibreglass, polycarbonate, or any other substance fulfilling the required operational functions, together with durability and safety. The present invention can also be applied to purposes other than its primary application as a sunshade.

The sunshade elements may be constructed from flat, relatively narrow sheets that may be easy to manufacture, readily available, inexpensive, easy to install, or any combination of these attributes.

The apertures may be open spaces (suitable for plant nurseries or horticultural purposes) where the penetration of rain and the free circulation of air is required. Or the apertures may be enclosed with transparent or translucent material, weather proofing the undercover area. Such material may with advantage in some applications have light refracting and diffusing properties. This dispersal of light would diminish or eliminate the shadow bars formed in spring, winter and autumn, and diminish the bright contrast of sunshine strips formed in early autumn and late spring. This would be most desirable for drawing offices and exhibition halls and the like.

The basic design principles of the present invention can be adapted to perform the following non-exhaustive list of functions:

| | |
|---|---|
| Sun/shade device | Chronometer |
| Shade/light device | Topographical simulator |
| Skylight | Patterning light device |
| Temperature moderating device | Field laboratory research |
| UV protection device | Celestial tracking device |
| Steep temperature contrast device | Astronomical application |
| Energy saving device | Education tool |
| Calendar | Beach shade |

The present invention can be used in respect of the following non-exhaustive list of structures and situations:

| | |
|---|---|
| Homes | Equipment sheds |
| Stadiums | Storage sheds |
| Pavilions | Animal sheds |
| Grandstands | Caravans |
| Waiting sheds | House-boats |
| Railway stations | Shade-houses |
| Walkways | Drawing offices |
| Arcades | Workshops |
| Windows | Picnic sheds |
| Awnings | Skylights |
| Eaves | Studios |
| Pergolas | Balconies |
| Libraries | Courtyards |
| Swimming pools | Verandahs |
| Playgrounds | Buildings |
| Plant Nurseries | On roofs |
| Educational Purposes | Glass houses |
| Wharves | Art Galleries |
| Exhibition Hall | Museums |

-continued

| | |
|---|---|
| Glass roof support ribs | Attached to walls |
| Horticultural/agricultural research stations | Envelope of a house |

Thus, although the invention has been described with reference to specific examples, it will be appreciated by those skilled in the art that the invention may be embodied in many other forms.

The invention claimed is:

1. A sunshade installation including a plurality of spaced apart sunshade elements, each of said sunshade elements forming an inclined arch and said plurality of sunshade elements forming an array of inclined arches substantially parallel to each other and aligned to extend in a generally north-to-south direction;

each of said sunshade elements having a reference shade point in a shade area, said sunshade elements being configured such that each sunshade element has a thin profile approximating a reference solar path when viewed from said reference shade point, the reference solar path being the diurnal solar path viewed from the reference shade point over predetermined days in winter, thereby maximising the direct admission of sunshine to the shade area over said predetermined days;

said sunshade elements being configured such that each sunshade element presents the maximum or near maximum breadth of its face when it is viewed from the reference shade point and appears as a broad arc approximating the reference band of diurnal solar paths occurring over a predetermined period in summer, thereby providing blocking of sunshine to the shade area; thus resulting in the direct admission of sunshine in winter and the blocking of sunshine in summer, and wherein during the spring period winter sunshine is gradually replaced by summer shade and during the autumn period summer shade is replaced by winter sunshine, such that the sunshade elements provide effective blocking and direct admission of sunshine to the shade area over the annual solar cycle.

2. The sunshade installation as claimed in claim 1 wherein each sunshade element has a nominal slat length and a nominal slat width substantially normal to said nominal slat length, wherein the nominal slat width of each element is aligned substantially along a straight line defined between a respective point along the reference solar path and the reference shade point such that the nominal slat width is tilted at a critical angle substantially equal to the angular altitude of the respective point along the reference solar path; and the nominal slat segment length being substantially parallel to the tangent to the reference solar path at the respective point along the reference solar path.

3. The sunshade installation as claimed in claim 1, wherein said sunshade element is a V shaped arch having a slat width substantially normal to an arch slat length, the slat width at each point along the arch slat length being aligned substantially along a straight line defined between a respective point along the reference solar path and the reference shade point, such that the slat width at each point along the arch slat length is tilted at a critical angle substantially equal to the angular altitude of the respective point along the reference solar path.

4. The sunshade installation as claimed in claim 3 wherein said sunshade element comprises two interconnected arms, each having a nominal slat width substantially normal to a nominal slat length, wherein said interconnected arms are oriented to extend in substantially eastern and western directions respectively, such that the axis of the sunshade element extends in a generally north-south direction.

5. The sunshade installation as claimed in claim 1 wherein each sunshade element is an arcuate slat having a slat width substantially normal to an arcuate slat length, the slat width at each point along the arcuate slat length being aligned substantially along a straight line defined between a respective point along the reference solar path and the reference shade point, such that the slat width at each point along the arcuate slat length is tilted at a critical angle substantially equal to the angular altitude of the respective point along the reference solar path.

6. The sunshade installation as claimed in claim 1, wherein said sunshade element is adjustable to dynamically block and admit sunshine to the shade area over the diurnal and annual solar cycles.

7. The sunshade installation as claimed in claim 6, wherein said sunshade element is automatically adjustable.

8. The sunshade installation as claimed in claim 1, wherein said sunshade elements are substantially identical.

9. The sunshade installation as claimed in claim 1, wherein sunshade elements are spaced uniformly apart.

10. The sunshade installation as claimed in claim 1, wherein each sunshade element has a substantially uniform width.

11. The sunshade installation as claimed in claim 1, wherein each aperture has a substantially uniform width.

12. The sunshade installation as claimed in claim 1, wherein the width of a sunshade element and the width of an aperture are both selected to define a width-ratio such that the sunshade elements block sunshine to the shade area over predetermined days in summer.

* * * * *